US012258764B2

(12) United States Patent
Santos

(10) Patent No.: US 12,258,764 B2
(45) Date of Patent: Mar. 25, 2025

(54) STAIRCASE WITH ADJUSTABLE HEIGHT RISERS

(71) Applicant: Vaea Augustino Santos, Vallejo, CA (US)

(72) Inventor: Vaea Augustino Santos, Vallejo, CA (US)

( * ) Notice: Subject to any disclaimer, the term of this patent is extended or adjusted under 35 U.S.C. 154(b) by 296 days.

(21) Appl. No.: 18/174,286

(22) Filed: Feb. 24, 2023

(65) Prior Publication Data

US 2024/0287811 A1 Aug. 29, 2024

(51) Int. Cl.

| | |
|---|---|
| ***E04F 11/02*** | (2006.01) |
| ***E04F 11/025*** | (2006.01) |
| ***E04F 11/104*** | (2006.01) |
| ***E04F 11/18*** | (2006.01) |

(52) U.S. Cl.

CPC ..... *E04F 11/0255* (2013.01); *E04F 11/1041* (2013.01); *E04F 11/1834* (2013.01); *E04F 2011/1821* (2013.01); *E04F 2011/1827* (2013.01)

(58) Field of Classification Search

CPC ..... E04F 11/0255; E04F 11/1041; E04F 11/1834; E04F 2011/1821; E04F 2011/1827

See application file for complete search history.

(56) References Cited

U.S. PATENT DOCUMENTS

| | | | | |
|---|---|---|---|---|
| 1,811,709 | A | 6/1931 | Bessler | |
| 2,580,978 | A | 1/1952 | Triller | |
| 7,096,998 | B1 * | 8/2006 | Edmunds | B66B 9/0869 182/69.6 |
| 7,578,371 | B2 | 8/2009 | Allred | |
| 8,695,760 | B2 | 4/2014 | Winter | |
| 10,487,579 | B2 * | 11/2019 | Rodriguez | E06C 7/084 |

* cited by examiner

*Primary Examiner* — Mark R Wendell
(74) *Attorney, Agent, or Firm* — Stephen E. Zweig

(57) ABSTRACT

A staircase kit, device, and method that uses precut, fixed-sized components capable of producing building code-compliant staircases that can accommodate foot or more differences in home story heights. The design uses fixed-length stringers and adjustable height risers. The angle between the stringers to the floor changes depending on the height of the adjustable height risers and story height. The angles of the steps, stringers and banisters/handrails are configured to adjust with respect to the other components with the aid of turnbuckles and movable joints or bolts, thus keeping the steps and landings level at different story heights. This enables homeowners, generally exempt from contractor license requirements, to use a prefabricated kit to build code-compliant stairways in their homes with little or no staircase cutting or part modification.

20 Claims, 14 Drawing Sheets

STAIRCASE WITH ADJUSTABLE HEIGHT RISERS

BACKGROUND OF THE INVENTION

Field of the Invention

This invention is in the field of staircases and staircase construction kits.

Description of the Related Art

Staircases (stairs) generally comprise various elements. These include steps or treads typically placed on stringers, providing the treads' load-bearing support. The stringers give the basic zig-zag shape to the staircase. Risers, generally positioned between each step, as the name implies, help provide the elevation change between each step. Risers are typically positioned perpendicular to each step and are usually held in position by the stringer. Staircases usually have handrails or banisters to help the stair users keep their balance. These banisters are often attached to Newel posts at opposite ends of the stairway. The banisters often have balusters or spindles to help prevent falls from the staircase. The top of the stairs is often called the upper landing, and the bottom is often called the lower landing.

Stairs are a common building component and as a result, are the subject of numerous safety codes and building codes. For example, in California, building codes for homes require that stairs should be at least 36 inches wide, the risers should be between about 4 and 7-8 inches high, and the risers should be of consistent height within about ⅜ inches. The treads and risers should be level with a maximum slope of about two degrees. Staircases should also have handrails on each side and level landings.

Prior art stairs that comply with relevant building codes are generally fixed structures that are usually custom-built to fit the requirements of that particular building. In particular, the stairs must precisely accommodate the differences in height (story height) between the bottom of a lower floor and the bottom of the floor above. For residential buildings, this average story height often differs between about nine to about 10 feet, but this can vary greatly between houses, with some designs going up to 11-12 feet. Commercial buildings often have story heights of 14 feet or more. Thus "one size fits all" staircase designs generally tend to be infeasible. Instead, skilled labor, custom-cut materials (e.g., custom-cut stringers), and custom installation is usually needed.

Attic Stairs: variable height attic stairs are known in the art. These include various folding attic stairs, which can transition between a folded form stored in the attic and an unfolded form that can be pulled down to the floor below for attic access. Such attic stairs generally employ foldable or telescoping riser elements that are not of a fixed (constant) length (e.g., total length), but rather have a changeable length that can usually transition between a first shorter length to a second and longer length.

Due to their limited and temporary use, such attic stair designs are generally exempt from standard staircase codes. Instead, they can follow a different set of regulations that tend to be more permissive. Attic stairs are exemplified by Bessler, U.S. Pat. No. 1,811,709; Triller, U.S. Pat. No. 2,580,978; Allred, U.S. Pat. No. 7,578,371; Winter, U.S. Pat. No. 8,695,576; and others.

BRIEF SUMMARY OF THE INVENTION

The invention was inspired, in part, by the insight that there is an unmet need for a staircase kit that would enable homeowners to install staircases into their pre-existing homes. Such homeowners are typically sophisticated "do it yourself" individuals who, although lacking professional carpenter or licensed contractor certification, often tackle medium-complexity home renovation projects. Such individuals are usually exempt from licensure requirements, but the finished product must still meet the required building codes.

More specifically, the invention was inspired, in part, by the insight that an ideal staircase kit should be able to adjust to a normal variation in one-story floor heights between most homes. Further, an ideal kit would contain all or nearly all of the required staircase components in a precut or pre-formed stage so that further modification is not needed. Instead, the homeowner should be able to take the precut (and fixed length) stringers, steps, risers, banisters/handrails/railings, and the like and assemble them into a code-compliant staircase. At the same time, this staircase needs to be adjustable to accommodate 1-2 foot differences in story height between buildings and still provide level steps and landings.

As will be discussed, in some embodiments, the invention can comprise a kit for producing a staircase device, the staircase itself, or a method of making a staircase. This staircase will generally comprise staircase components such as various steps, adjustable height risers, fixed-length banisters, fixed-length stringers, and Newel posts. The staircase will also comprise a lower landing and an upper landing. Unlike standard designs, the invention's adjustable height risers typically comprise a top riser portion connected to a bottom riser portion by at least one riser hinge. This adjustable height riser enables the riser height to be adjusted by changing the angle (here called the two-portion angle) between the top and bottom riser portions.

For this to work with precut (or pre-formed) stringers, the angle of the staircase itself has to be adjustable. When the story height is longer, the staircase angle (FIG. 2. 101) is steeper, and the staircase angle is shallower when the story height is shorter. This in turn, requires that many of the staircase components be configured to adjust or rotate somewhat depending on the desired staircase angle. In particular, the adjustable staircase disclosed here is configured so that adjusting a height between the lower landing and the upper landing comprises modifying the riser two-portion angle over at least some (usually all) of the various adjustable height risers. The other adjustable components will be further disclosed in detail shortly.

DETAILED DESCRIPTION OF THE INVENTION

In some embodiments, the invention may be an adjustable-height staircase or a method of assembling such a staircase. Although configured to be adjustable, this staircase is generally configured to conform to standard US building codes. Among other things, the staircase risers will generally be no shorter than 4 inches high and no taller than 7½ inches high (versions intended for other areas, such as Canada, may have taller risers, such as 8¼ inches high. To avoid creating a tripping hazard and to comply with various building codes, it is generally preferable (or required) to configure all the risers to the same height.

The staircase steps or run will generally be at least 10 inches long. Further, when assembled, the steps will be level with respect to the underlying floor (or, preferably, gravity).

Figure 1:
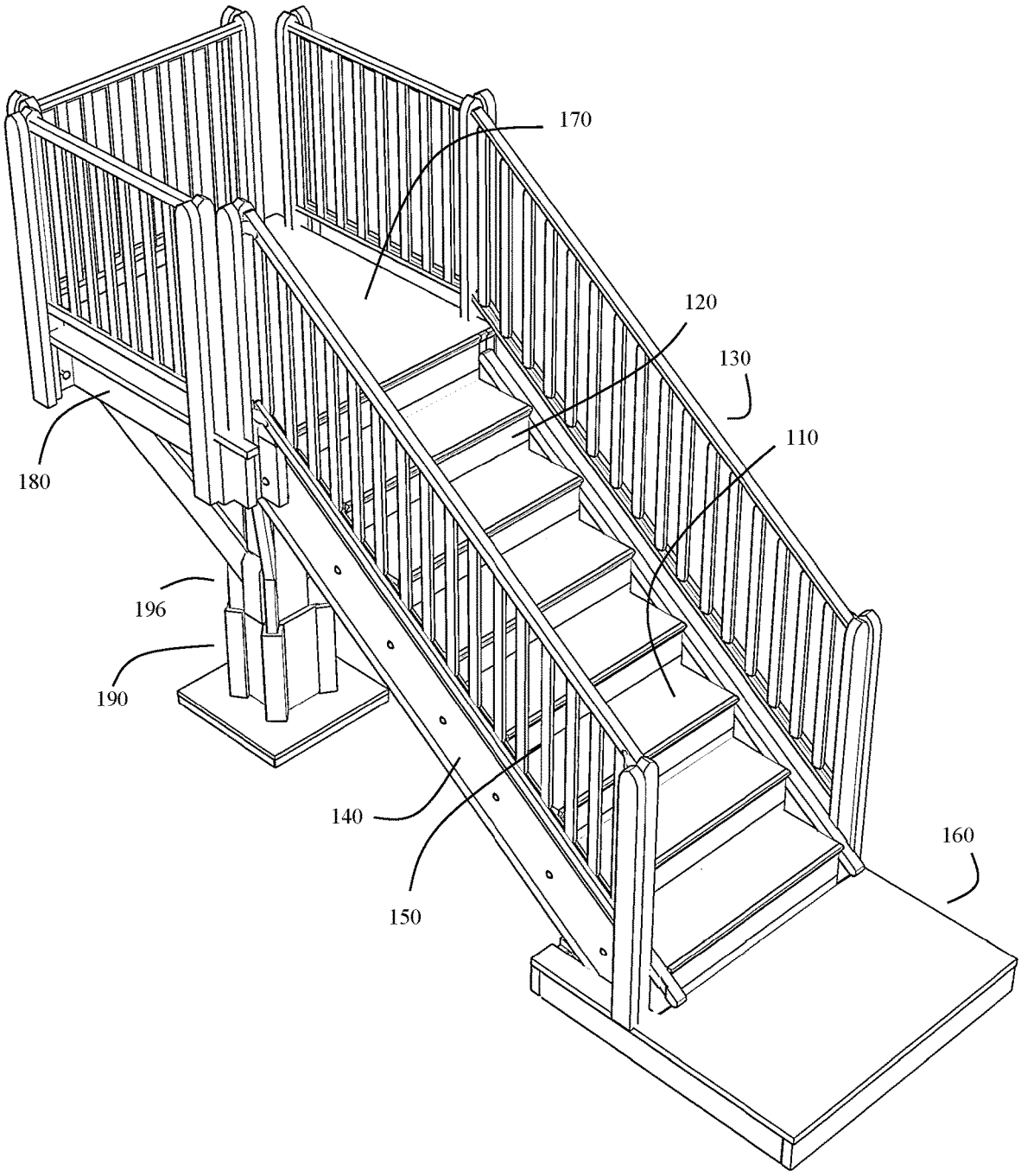
FIG. 1 shows an overhead perspective overview of the adjustable stair system.

More specifically, the invention may be a staircase device or a method of assembling a staircase device, generally as shown in FIG. 1. In some embodiments, the staircase components will be precut and provided as a kit so that a professional carpenter is not always needed to install the staircase. Further, a single standardized kit with precut components may be provided that can accommodate different floor heights in different buildings. For example, FIG. 1 shows an example of a staircase with eight risers. Depending on the height of these risers, using the same components, the staircase of FIG. 1 can be configured to adjust to differences in height of up to about one to two feet between adjacent floors.

Figure 2:
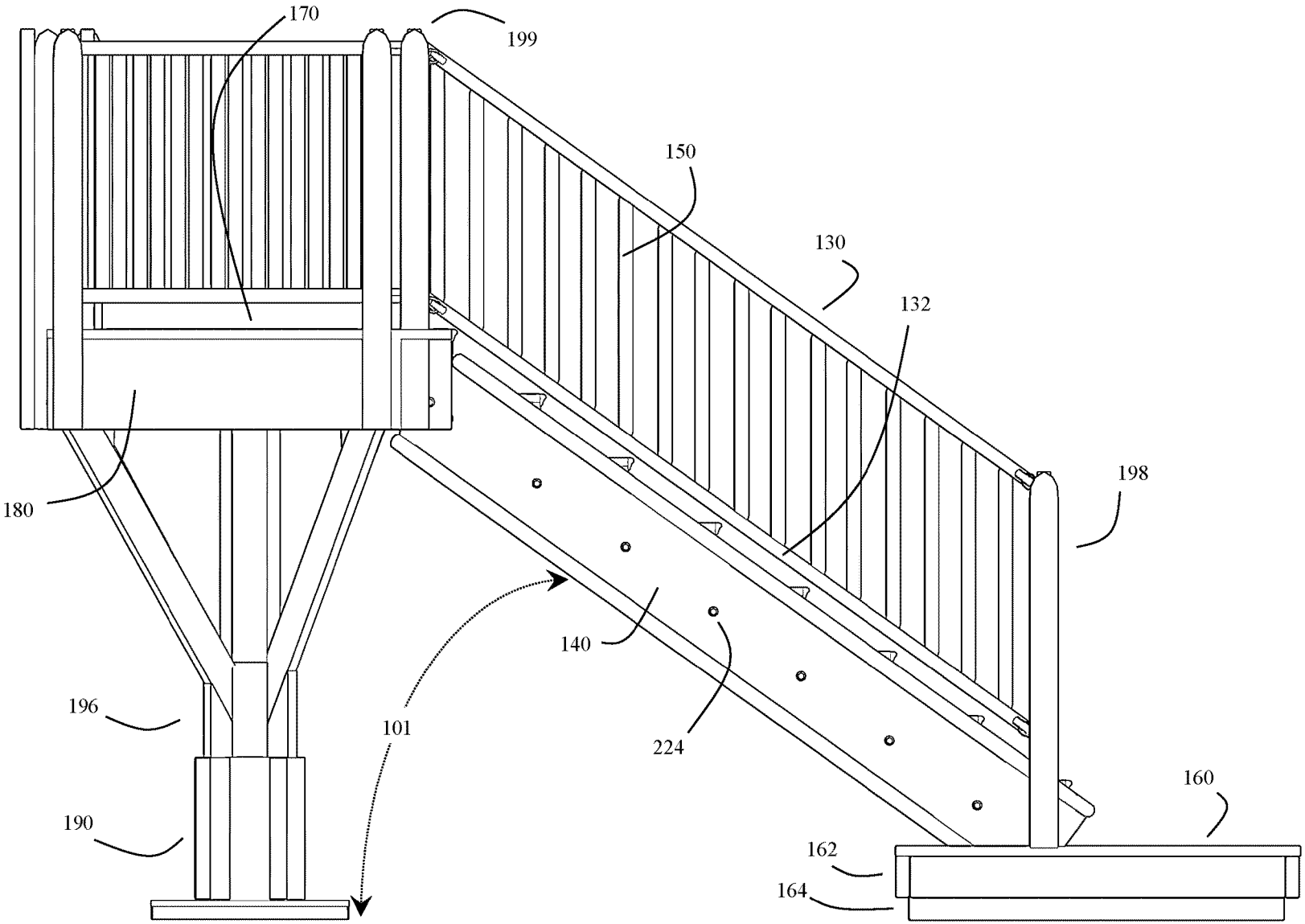
FIG. 2 shows a side view of the adjustable stair system.

Thus, in some embodiments, the invention may be a staircase or a method of assembling a staircase. This staircase will generally comprise various staircase components, such as a plurality of steps (110), a plurality of adjustable height risers (or riser components that can be configured to make adjustable height risers 120), fixed-length banisters (130), fixed-length stringers (150), Newel posts (FIG. 2: 198, 199). The staircase will usually also have a lower landing (160) and an upper landing (170).

Figure 7:
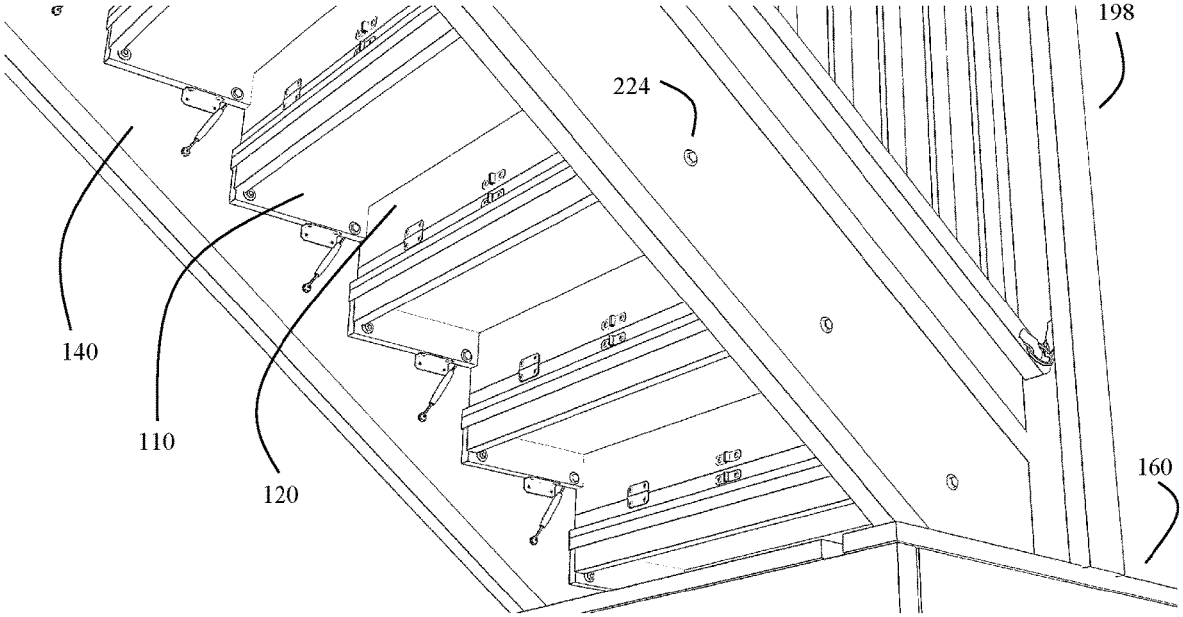
FIG. 7 shows a detail of the underside or backside of the stairs, showing an overview of some of the hardware that is attached to the underside or backside.
Figure 8:
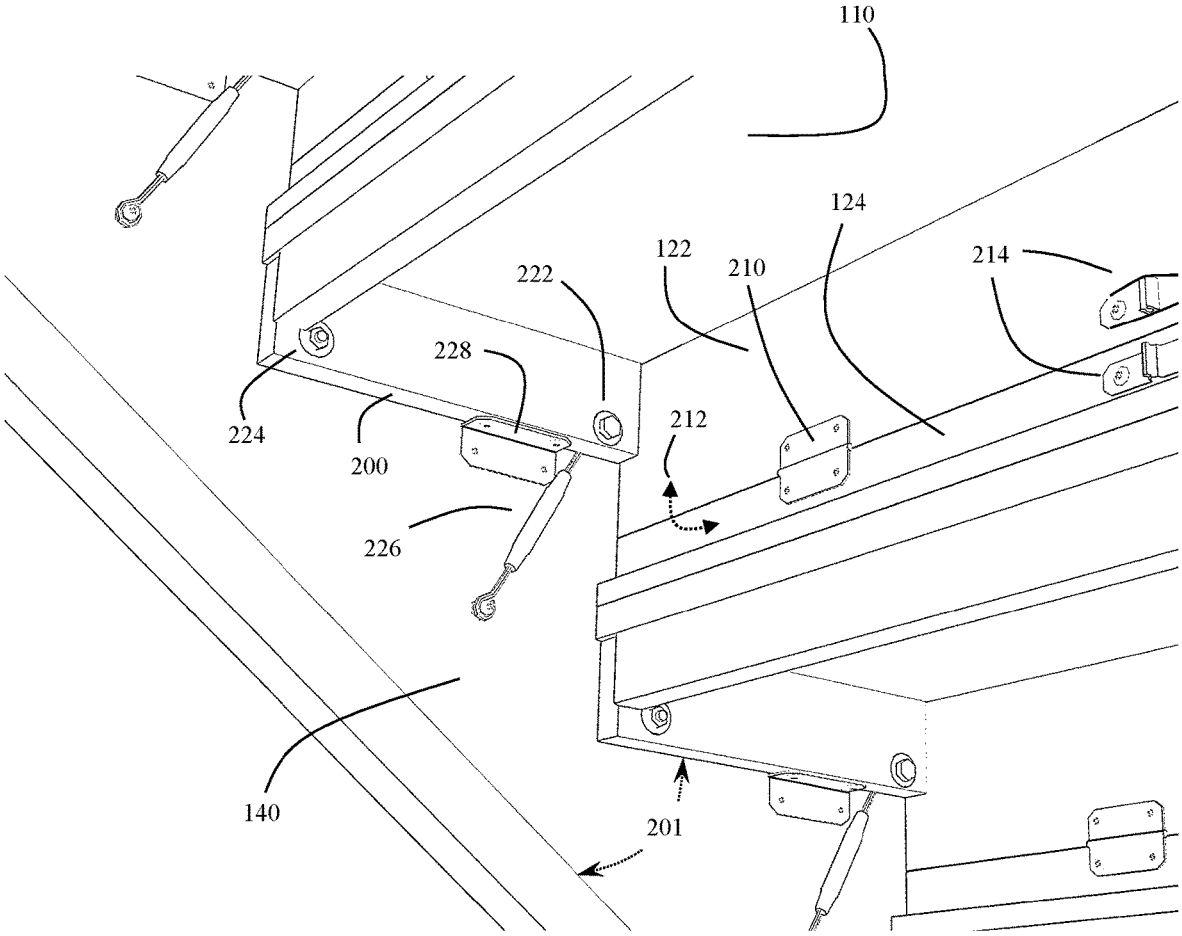
FIG. 8 shows a closer view of the underside or the back side of the stairs, showing some of the hardware in more detail.

Here, as shown in more detail in FIGS. 7 and 8, each adjustable height riser (120) will comprise comprising a top riser portion (122) connected to a bottom riser portion (124) by at least one riser hinge (210), so that the height of the adjustable height riser is configured by a two-portion angle (212) between the top riser portion (122) and the bottom riser portion (124).

According to the invention, the height between the upper landing (170, presumably level with a higher floor level) and the lower landing (160, presumably adjusted to the level of the floor below) can be adjusted, at least in part, by modifying this two-portion angle (212) over at least some (and often all) of these various adjustable height risers. As can be seen, when the riser hinges (210) are folded back on each other, the height of the total riser is about equal to only the height of the top riser portion (122). By contrast, when the riser hinge is unfolded and is essentially straight (as shown in FIG. 8), the height of the total riser is equal to the height of the top riser portion (122) and the bottom riser portion 124. So, if, for example, the height of the top riser portion 122 is four inches, and the height of the bottom riser portion 124 is three inches, the height of the total riser can vary between about four inches and about seven inches.

FIG. 1 shows an overhead perspective overview of the adjustable stair system (100), showing the steps (110), adjustable risers (120) banister upper railings (130), stringers (140), spindles (balusters) (150), lower landing step (160), upper landing (170), upper landing frame (180), adjustable support post base (190), and adjustable support column (196).

FIG. 2 shows a side view of the adjustable stair system (100). This shows the banister upper railings (130) and banister lower railings (132), the stringers (140), spindles (150), lower landing step (160), upper landing frame (180), adjustable support base (190) and adjustable support column (200 from a different angle. The lower Newel post (198) and upper Newel post (199) are also shown. Note that the extension of the banister and stringers into the flat area of the upper landing (170) is optional, and in some embodiments, is not present.

Figure 3:
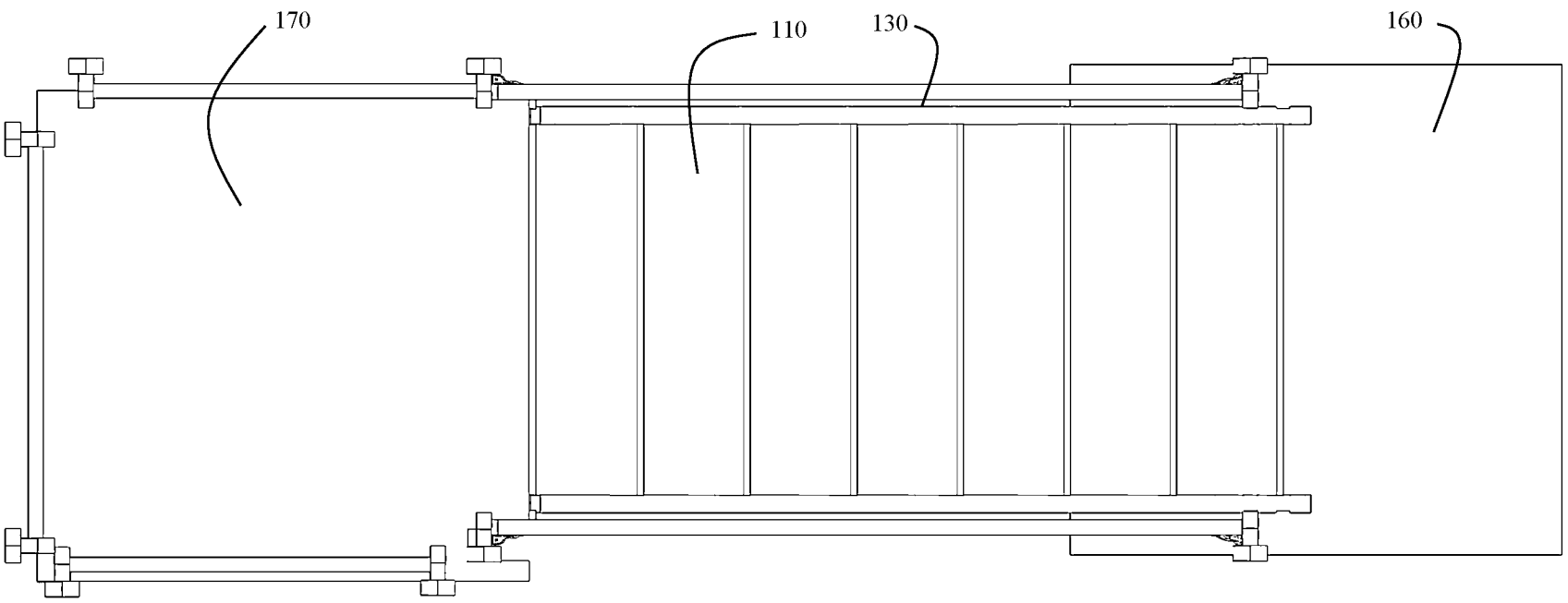
FIG. 3 shows a top view of the adjustable stair system.

FIG. 3 shows a top view of the adjustable stair system (100), showing the upper landing (170), steps (110), banister upper railings (130), and lower landing step (160) from a different perspective.

Figure 4:
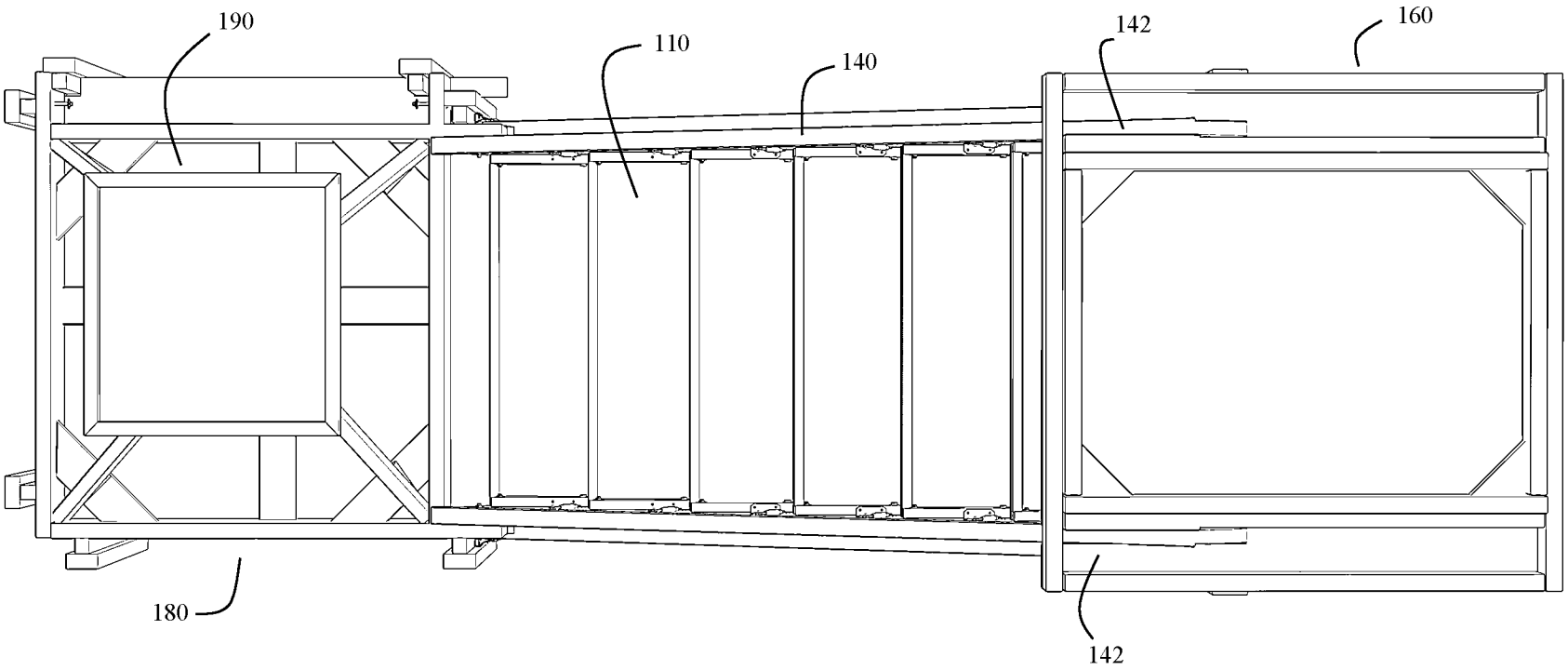
FIG. 4 shows an underside (bottom) view of the adjustable stair system.

FIG. 4 shows an underside (bottom) view of the adjustable stair system (100), showing additional details of the adjustable support base (190), the underside of steps (110), stingers (140), and lower landing step (160) from a different perspective. Note that a lower portion of the stringers (142) protrudes below the upper surface of the landing step.

Figure 5:
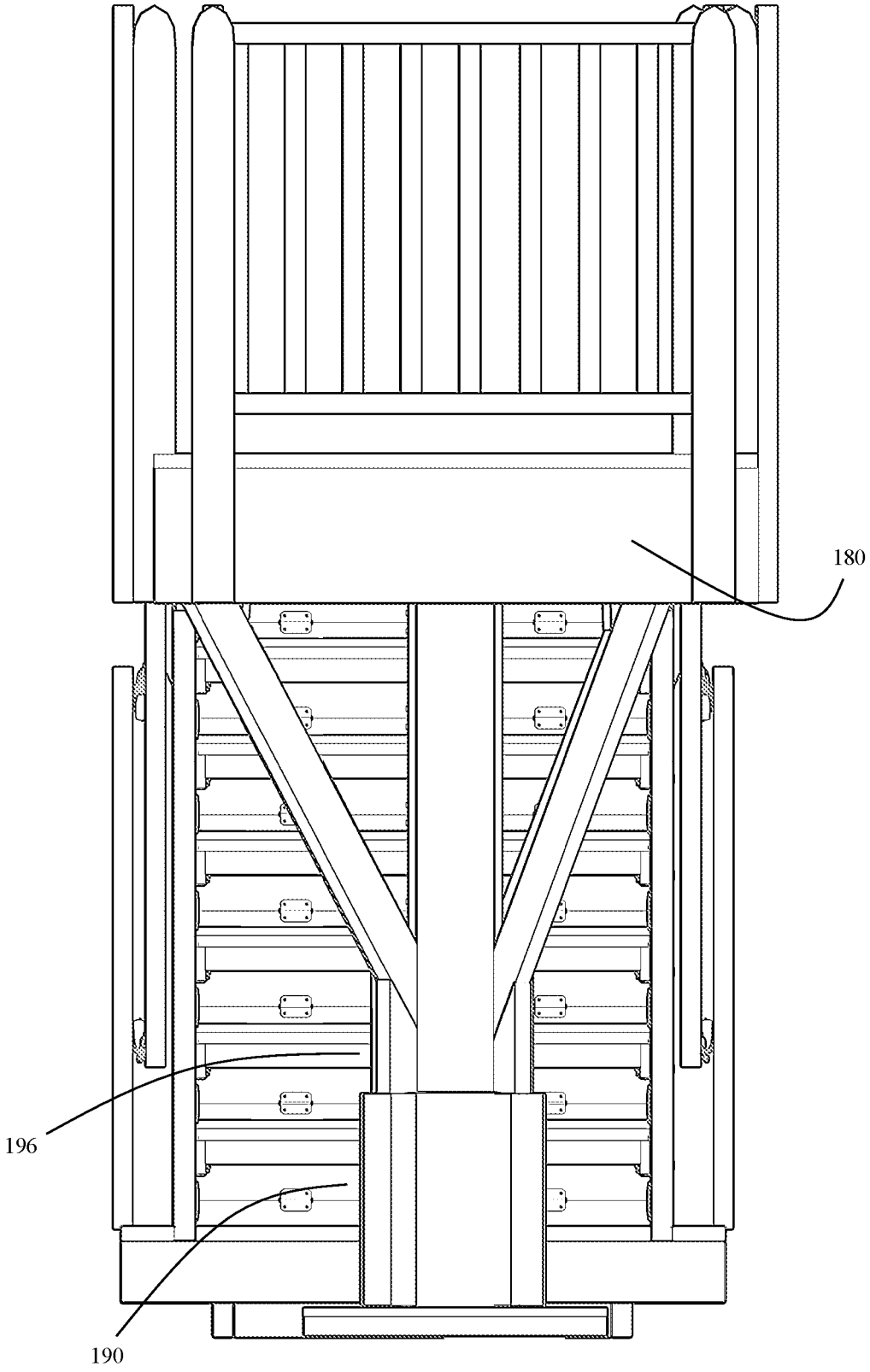
FIG. 5 shows a back view of the adjustable stair system.

FIG. 5 shows a back view of the adjustable stair system, showing additional details of the upper landing frame (180), adjustable support base (190), and adjustable support column (196). The details of the hardware will be discussed shortly.

In a preferred embodiment, as shown in FIG. 2, the upper landing (170) is often supported by an upper landing frame (180), and this upper landing frame (180) is, in turn, supported by an adjustable height post system (190, 196). This arrangement allows the height of the staircase (e.g., the height between the lower landing (160) and the upper landing (170) to be further adjusted by modifying the total height of this adjustable height post system (190, 196).

Note that a series of operations typically adjust the height of the staircase. In addition to adjusting the height of the risers (120), the height of the adjustable height post system (190, 196), the angle of the steps (110) (e.g., the step leveling process), and the angles of various other components are also adjusted.

The height of the adjustable height post system (190, 196) that supports the upper landing frame (180) and the upper landing (170) can be adjusted by various mechanisms. In the embodiment as shown, the adjustable height post system comprises an adjustable support post base (190), and an adjustable support column (196). In this example, the post base (190) and the support column configured (196) are configured to nest partially within each other. See also FIGS. 2, 5, and 6. In this embodiment, the height of the adjustable height post system can be adjusted by configuring an extent of overlap between the two (e.g., post base 190 and support column 196). The adjustable support column (196) rests snugly inside a hollow space inside the adjustable post base (190). The extent of overlap is adjusted until the desired total height is reached. Then the support column (190) is affixed in the desired position inside the post base (190) by various standard methods, such as nails, screws, bolts, glue, internal supports, or the like.

Figure 6:
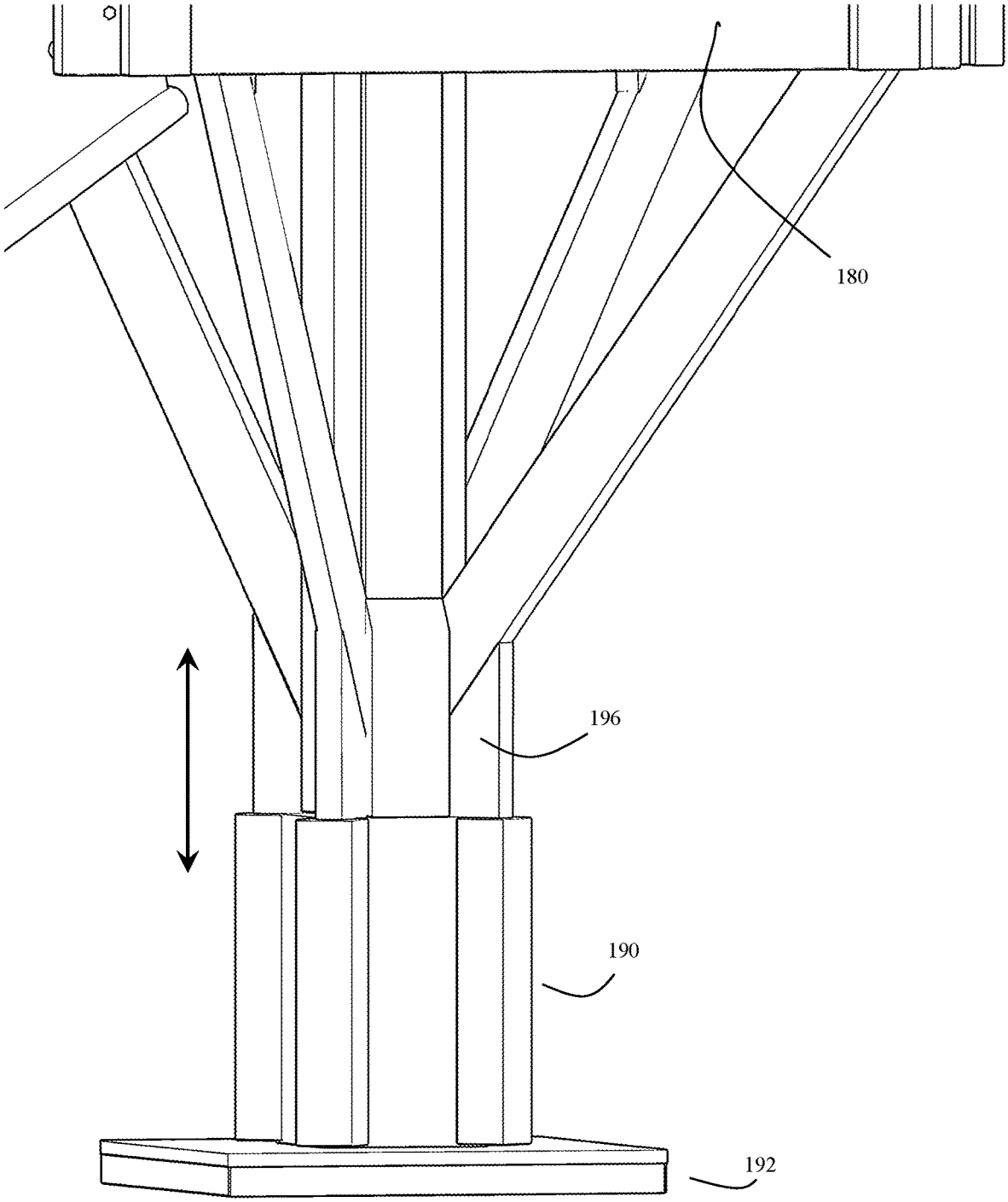
FIG. 6 shows a detail of the adjustable support base and adjustable support column.

Thus, as previously discussed, FIG. 6 details the adjustable support base (190) and adjustable support column (196). This support column (196) supports the upper landing frame (180). Depending on the stair configuration, the adjustable support column may be positioned higher or lower on the adjustable support base, thus enabling the upper landing frame and the upper landing (170) to be configured to different heights. An optional support base plate (192) is also shown.

FIG. 7 shows a detail of the underside or backside of the stairs, showing an overview of some of the hardware that is attached to the underside or backside of the stringers (140), underside or backside of the steps (110), and underside or backside of the risers (120). As discussed, this hardware enables the height of the risers to be adjusted.

Note that if the height of the risers (120) is adjusted, then to maintain the steps (120) at a level orientation with respect to gravity, then the angle of the various steps (110) with respect to the stringers (140) must also be adjusted. Otherwise, the steps would be at an angle, creating a tripping hazard and violating various building codes. Thus, a mechanical arrangement is needed to adjust the angle between the steps and the stringers.

As shown in FIG. 7 and FIG. 8, at least some of the steps (110) are attached to the fixed length stringers (140) by pivot bolts or pivot joints, as well as an optional adjustable runner (200). Here, the step-stringer angle (201) between at least some of the steps (110) and the fixed length stringers (140) is adjustable depending on the height of the adjustable height riser (120). The staircase height is further adjusted by adjusting the step-stringer angles (201) so that substantially all of the steps are level.

In some embodiments, at least some of the steps (110) in the plurality of steps are further attached to the fixed length stringers (140) by at least one turnbuckle adjusted apparatus (such as 200, 224, 222, 226). This apparatus comprises a turnbuckle (226) with a variable turnbuckle length. With this apparatus, the process of adjusting the height between the lower landing and the upper landing further comprises modifying the variable turnbuckle length. This turnbuckle can then adjust the various step-stringer angle(s) so that all the steps are level.

As shown in FIG. 8, one end of the turnbuckle (226) is attached to an adjustable runner (200), by bolt 222. This adjustable runner (200) is attached to the stringer (140) by an adjustable runner pivot bolt (224). Thus, when the length of the turnbuckle (226) is increased or decreased, this exerts force on the adjustable runner (200) that is immediately below the step (110) and is parallel to this step. This causes the step (110) to pivot up or down relative adjustable runner and the adjustable runner bolt (224). Ideally, the turnbuckle (226) is adjusted to the proper length where step (110) is level (with respect to gravity) at whichever riser length (120) is selected. Once the proper angle is set, the adjustable runner (200) may then be more securely fixed at the desired angle using an angled hinge (228).

Put alternatively, FIG. 8 shows a closer view of the underside or the back side of the stairs, showing some of the hardware in more detail. Note that the risers (120) comprise a top riser portion (122) and a bottom riser portion (124). The top riser portion (122) will often be about six inches in height, and the bottom riser portion (124) will often be about two inches in height. The two riser portions are connected by riser hinges (210) that allow the bottom riser portion to swing back at a two-portion angle (212), which usually is either 180 degrees (straight) or 270 degrees (bent-inward right angle). Thus, when the top riser portion (122) is in line with the bottom riser portion (124), the height of the entire top riser (120) will be about eight inches. But when the bottom riser portion (124) is folded at a 90-degree angle (bent-inward 270 degrees) with respect to the top riser portion (122), then the height of the entire top riser (120) will only be about six inches. When this happens, the folded bottom riser (124) may be kept in the folded position by a clasp or hook arrangement (214).

To accommodate this change in riser length (120), the entire staircase, in turn, has to both adjust its overall height (by way of adjusting the overlap between the adjustable support base (190) and the adjustable support column (196). Additionally, the angle between the various steps (110) and the stringer (140) also has to be adjusted so that the resulting steps always are level with respect to the ground, regardless of the height of the risers (120). Further, the angle of the banister upper and lower railings (130), (132), and even the stringers (132) also must be adjusted. To do this, these components are mounted on various types of pivot joints. Indeed, as will be discussed, even the joints or attachment hardware between the banister (130) and the Newel posts (198, 199) is configured to allow this movement to occur.

To do this, the risers (122) are connected to adjustable runners (220) by runner pivot bolts (222), stringer pivot bolts (224), and turnbuckles (226). As needed, applying torque to the turnbuckle (226) causes the length of the turnbuckle to expand or contract. This, in turn, is communicated to the underside of the step (110) by the adjustable runner (200), which in turn pivots around the stringer pivot bolt (224) attached to the back side of the stringer (140). After adjustment, the desired orientation can be further stabilized with an optional "L" corner brace (228).

Figure 9:
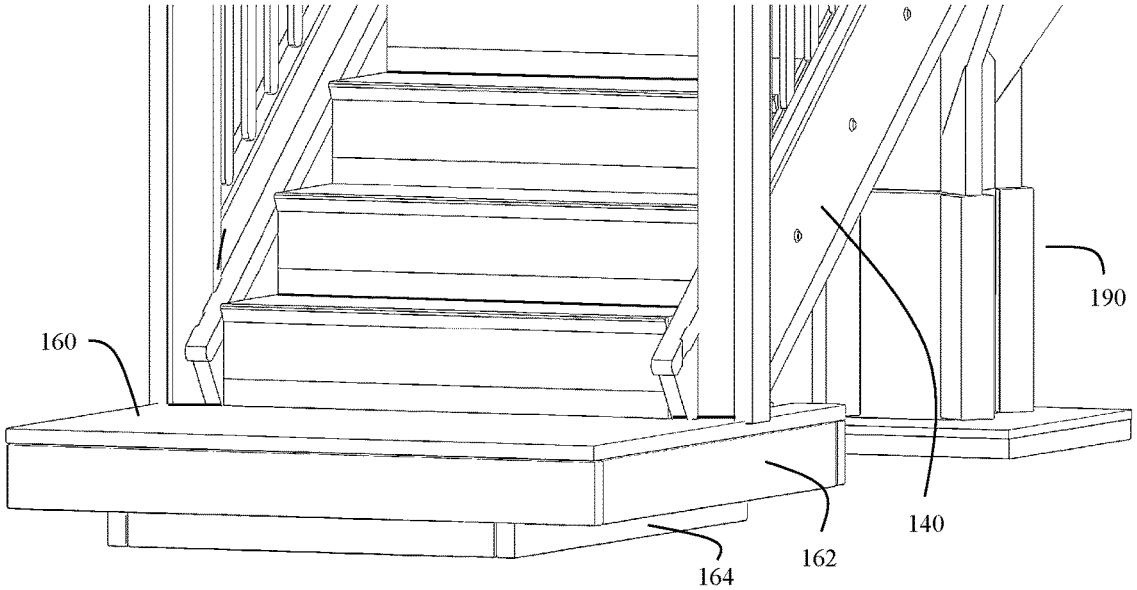
FIG. 9 shows a closer view of the stair's landing area.
Figure 10:
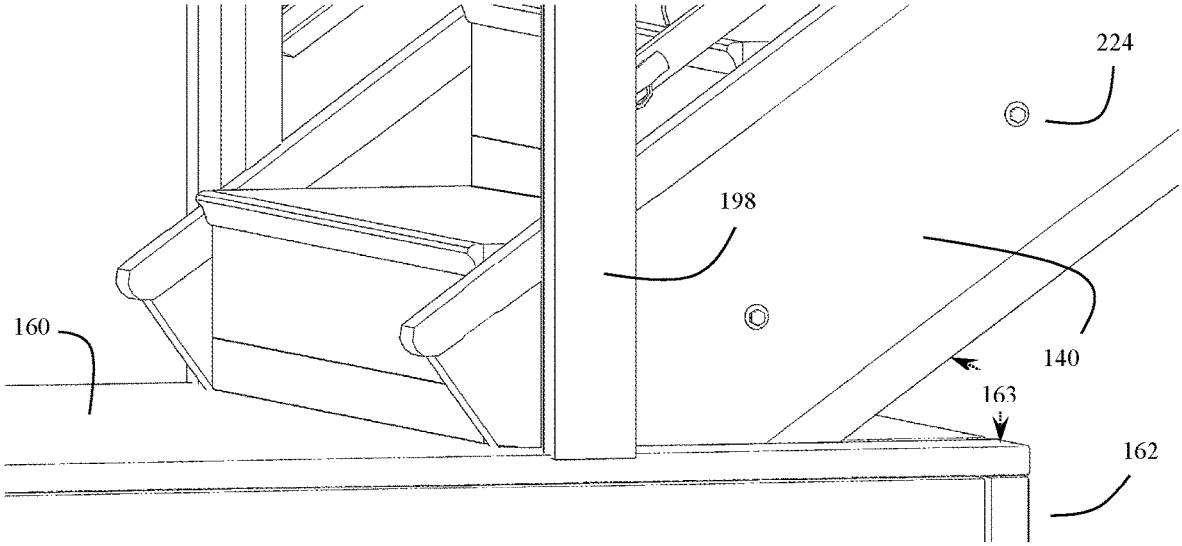
FIG. 10 shows a close-up top side view of the stair's landing area.
Figure 11:
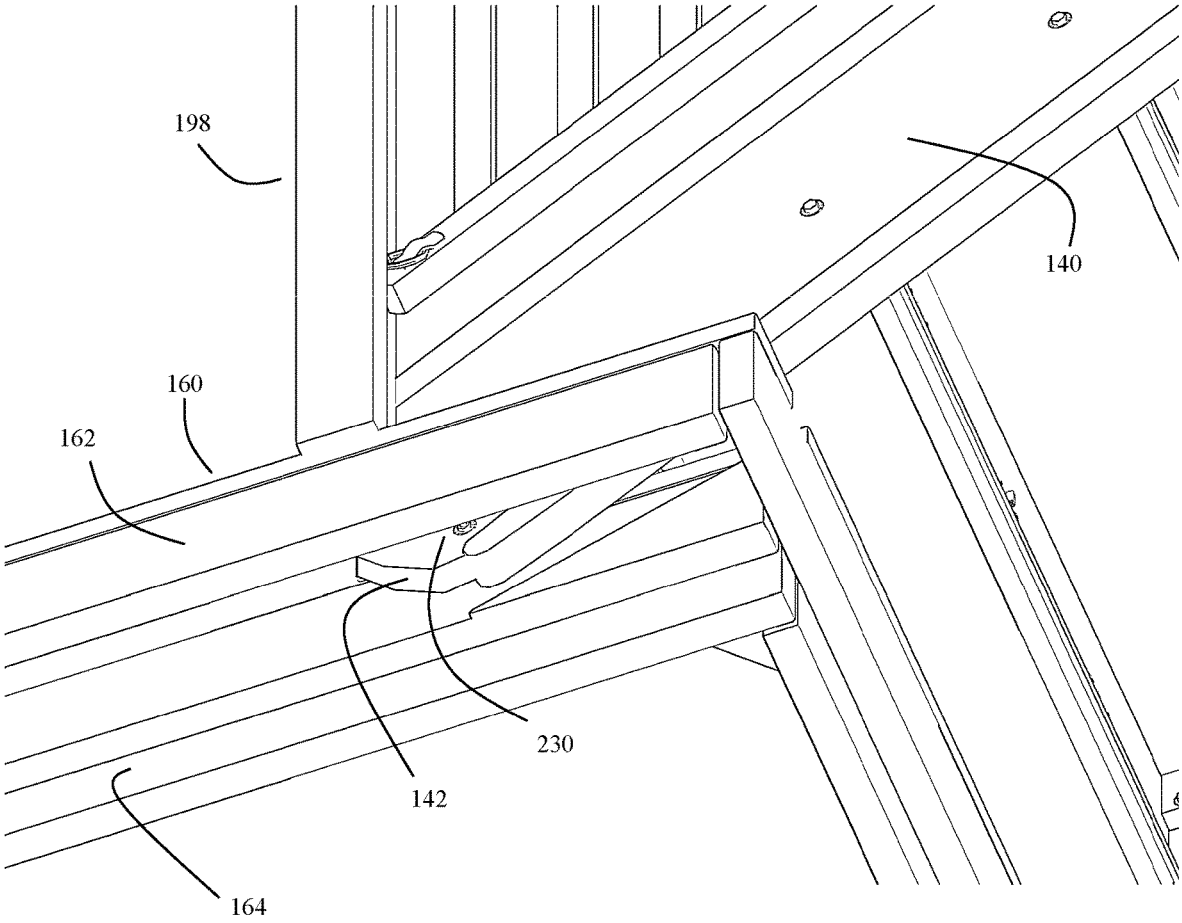
FIG. 11 shows a close-up bottom side view of the stair's landing area.

The Lower Landing:

As shown in FIGS. 9-11, in some embodiments, the lower landing (160) is supported by a lower landing frame (162) with a lower landing frame height and lower landing (internal) space. Due to differences in riser height (120), the fixed-length stringers (140) need to pivot somewhat to accommodate differences in staircase height. To do this, a lower portion (FIG. 11, 142) of the fixed-length stringers (140) can be configured to extend through a slot or hole in the lower landing (160) into the lower landing space. This is the space underneath the landing (160) that is defined by the dimensions (height and area) of the lower landing frame (162).

To allow the stringers (140) to pivot somewhat, each stringer can be attached to either the lower landing (160), or the lower landing frame (162) by a lower landing pivot mechanism such as a pivot bolt or joint (230). Thus, variations in staircase height, caused at least in part by alterations in riser height (120), end allowing a stringer-lower-landing angle (FIG. 10, 163) of the stringers with respect to the lower landing to vary depending on the height of the adjustable risers (120) and/or the overall height of the staircase.

Put alternatively, FIG. 9 shows a closer view of the stair's landing area. Here, the lower landing step (160) is supported by an outer landing frame (162), which in turn is supported by an inner landing frame (164), forming a nested landing frame arrangement. This nested landing frame arrangement allows for the height of the landing frame (162) and lower landing step (160) to be adjusted up and down a few inches as needed.

FIG. 10 shows a close-up top-side view of the stair's landing area. Note that due to the adjustable nature of the stairs, the angle that the stringer (140) meets the lower landing step (160) needs to be adjusted up or down (such as +/−10 degrees). To do this, the lower portion of the landing stringer (lower landing stringer) protrudes through a slot in the lower landing step (160) and into the space defined by the lower landing frame (162). The lower portion of the landing stringer is supported by a lower landing stringer pivot bolt (230). As the risers are raised or lower, the stringer (140) rotates about the lower landing pivot bolt (FIG. 11, 230), thus allowing the angle (163) of the stringer (140) relative to the lower landing (160) to be adjusted as appropriate.

FIG. 11 shows a close-up bottom-side view of the stair's landing area. Here the lower portion of the stringer (142) is shown passing through a slot in the lower landing step (160) and extending into the space formed by the lower landing frame (162), and between the lower landing frame (162) and the inner landing frame. The stringer (140) pivots around the lower landing stringer pivot bolt (230).

The Banisters:

As shown in FIGS. 1, 2, 13, and 14, in some embodiments, each fixed-length banister can comprise a banister upper railing (130), a banister lower railing (132), and a plurality of spindles (150) mounted parallel to each other between the banister upper railing (130) and the banister lower railing (132). The Newel posts typically comprise 1-2 lower Newel posts (198) and 1-2 upper Newel posts (199). In a preferred embodiment, the fixed-length banister(s) are attached to the lower (198) and upper (199) Newel posts by at least one flexible linking mechanism, such as (240). This flexible linking mechanism is preferably configured so that the angle (FIG. 13, 197) between the fixed length banisters (132) and the Newel posts (198) can vary depending on any of the height of the adjustable risers (120) and/or the total height of the staircase.

Note that it is often desirable to ensure that the spindles (150) are always parallel with respect to the direction of gravity, regardless of how the banister tilts to accommodate differences in stairway height.

To do this, in some embodiments, the spindles (150) can be mounted between the banister upper railing (130) and the banister lower railing (132) using movable or pivoting joints (250). This enables the spindle angles (151) between the banister upper railing) and the banister lower railing (132) to vary depending on the height of the adjustable risers (120) as well as the height of the staircase and/or angle 197 between the fixed length banisters (132) and the Newel posts.

Figure 12:
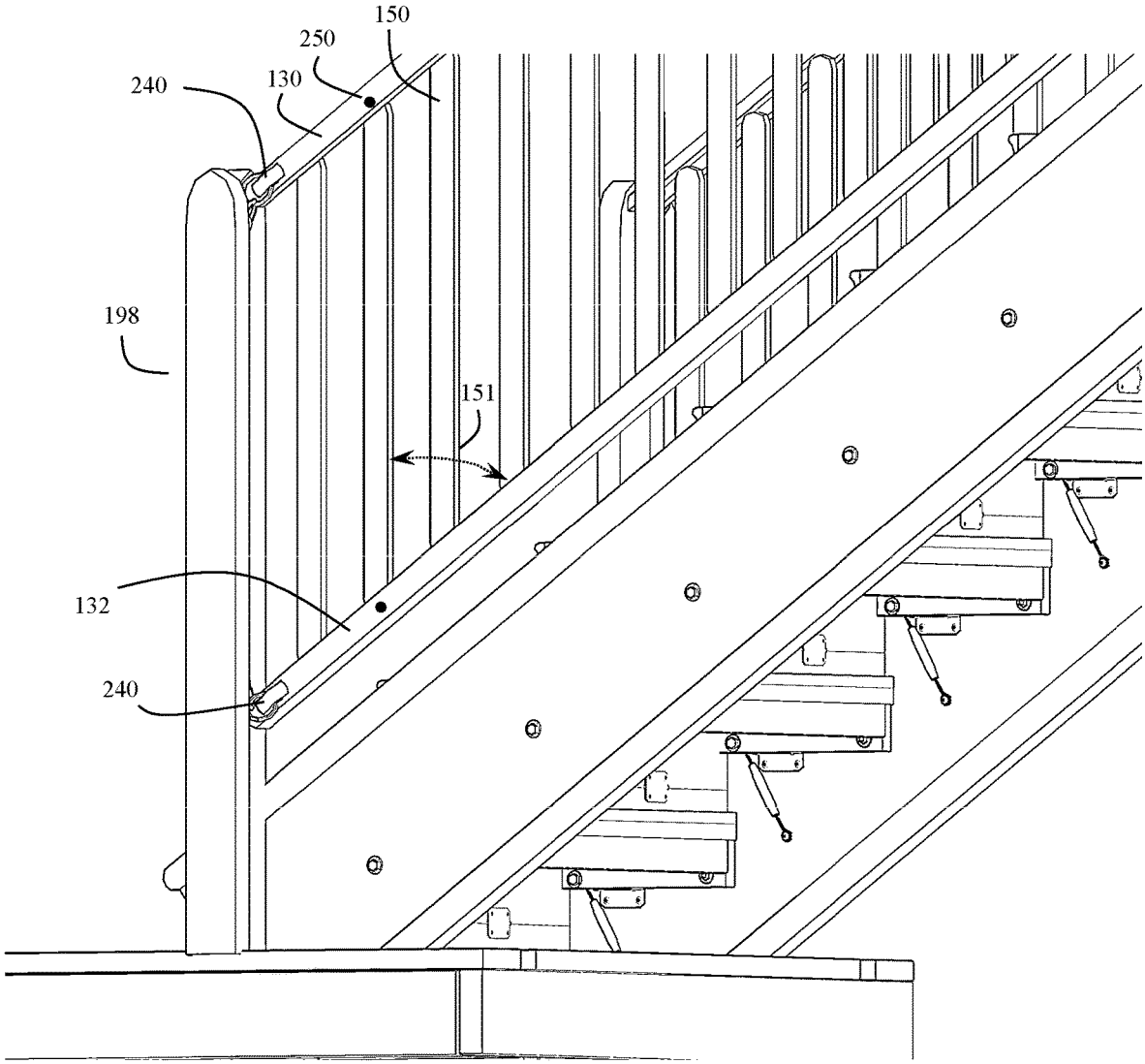
FIG. 12 shows a back bottom side view of the stair's landing area, showing how the banister upper and lower railings are attached to the lower Newel post.

Put alternatively, FIG. 12 shows a back bottom side view of the stair's landing area, showing how the banister upper and lower railings (130, 132) are attached to the lower Newel post (198). Because the angle of the banister relative to the Newel post will change depending on the riser height, the banister-to-Newel connecting hardware must also be capable of flexing and working at various angles. Various types of mounting hardware, such as hinges, and joints, may be used. In this embodiment, a rail linking mechanism (240) is used to connect the upper and lower banister railings (130), and (132) to both the lower (198) and upper (199) Newel post(s).

Additionally, note that the angle (151) between the spindles (150) and the upper and lower banister railings (130, 132) will also change somewhat as the riser height (and, therefore the angle of the stringers 140) changes. To do this, in some embodiments, the spindles will be attached to the upper and lower banister railings with spindle pivot joints or other mechanisms (250).

Attachment Between the Banisters and the Newel Posts

Figure 13:
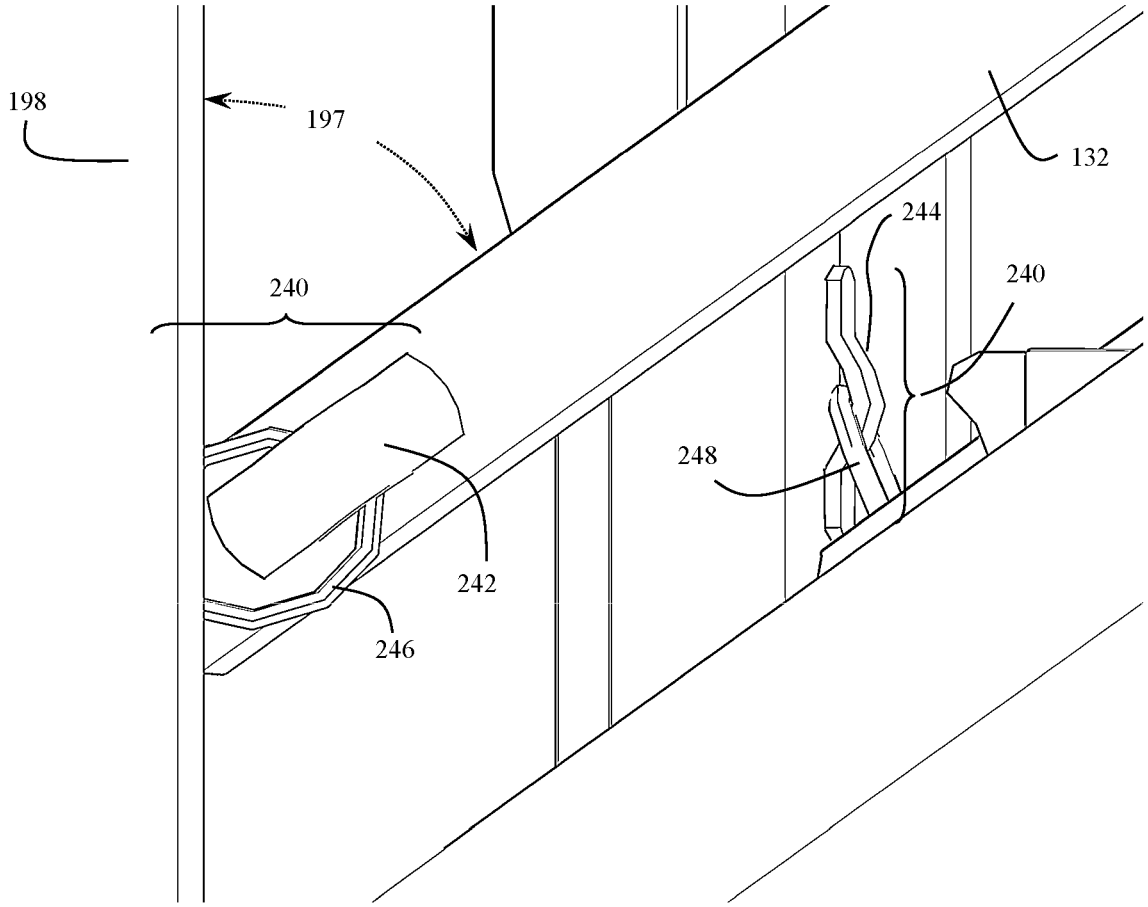
FIG. 13 shows a close up showing how the lower banister railings may be flexibly attached to the lower Newel posts using a linking mechanism.

FIG. 13 shows a close-up showing how the lower banister railings (132) may be flexibly attached to the lower Newel posts (198) using rail linking mechanisms (240). In this example, each rail linking mechanism (240, two are shown) is made up of two "U" shaped connector brackets (242, 244), one connected to the railing and the other to the Newel post) attached by two interlocking chain links (246, 248), thus creating a strong connection with some ability to move and rotate.

Figure 14:
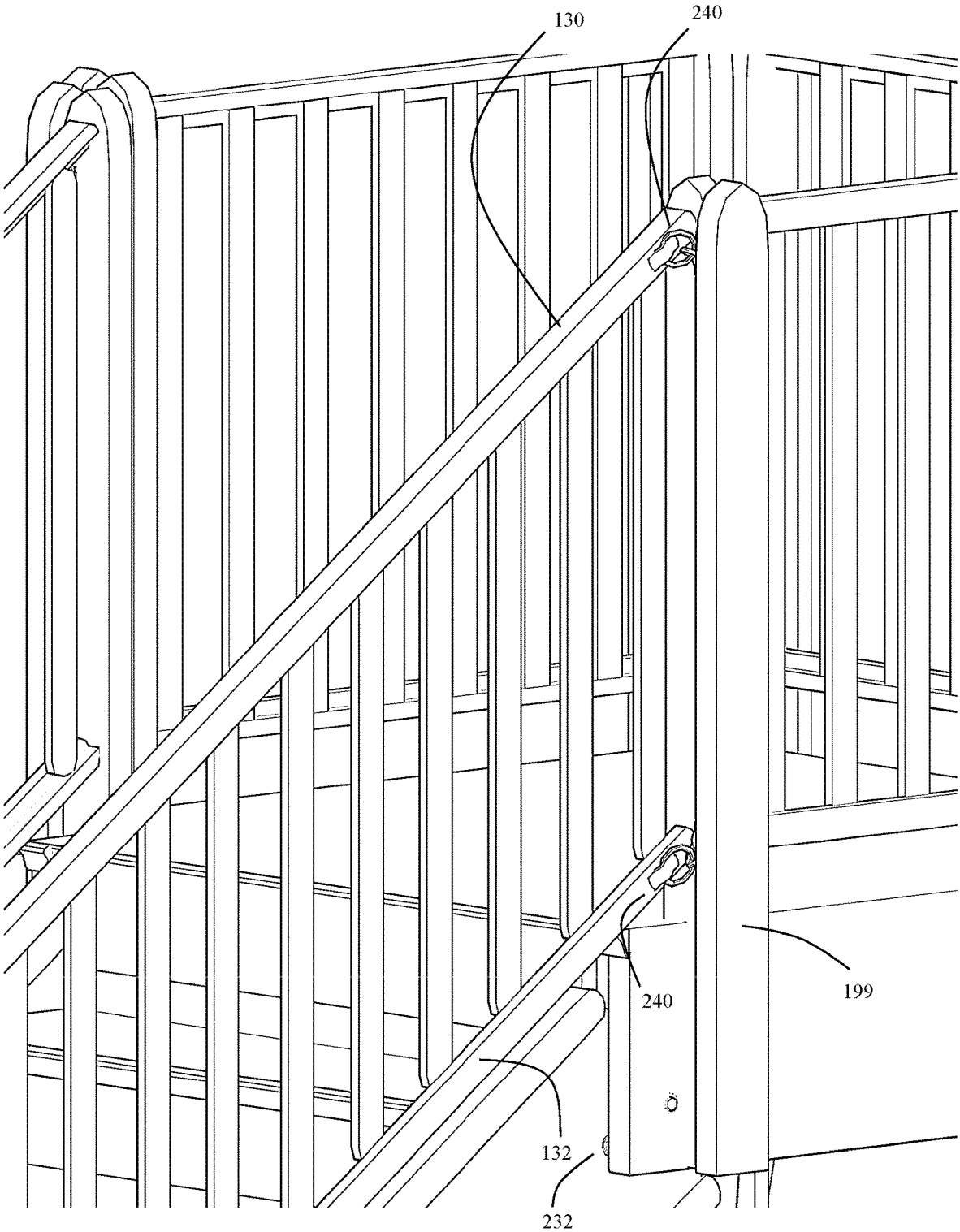
FIG. 14 shows a view of the top of the stairs, showing how the upper and lower banister railings are attached to the upper Newel posts by the same type of linking mechanisms.

FIG. 14 shows a view of the top of the stairs, showing how the upper and lower banister railings (130, 132) are attached to the upper Newel posts (199) by the same type of rail linking mechanisms (240). As the risers are raised or lower, the stringer (140) rotates about the upper landing pivot bolt (FIG. 14, 232), thus allowing the angle of the stringer (140) relative to the upper landing (170) to be adjusted as appropriate.

Figure 15:
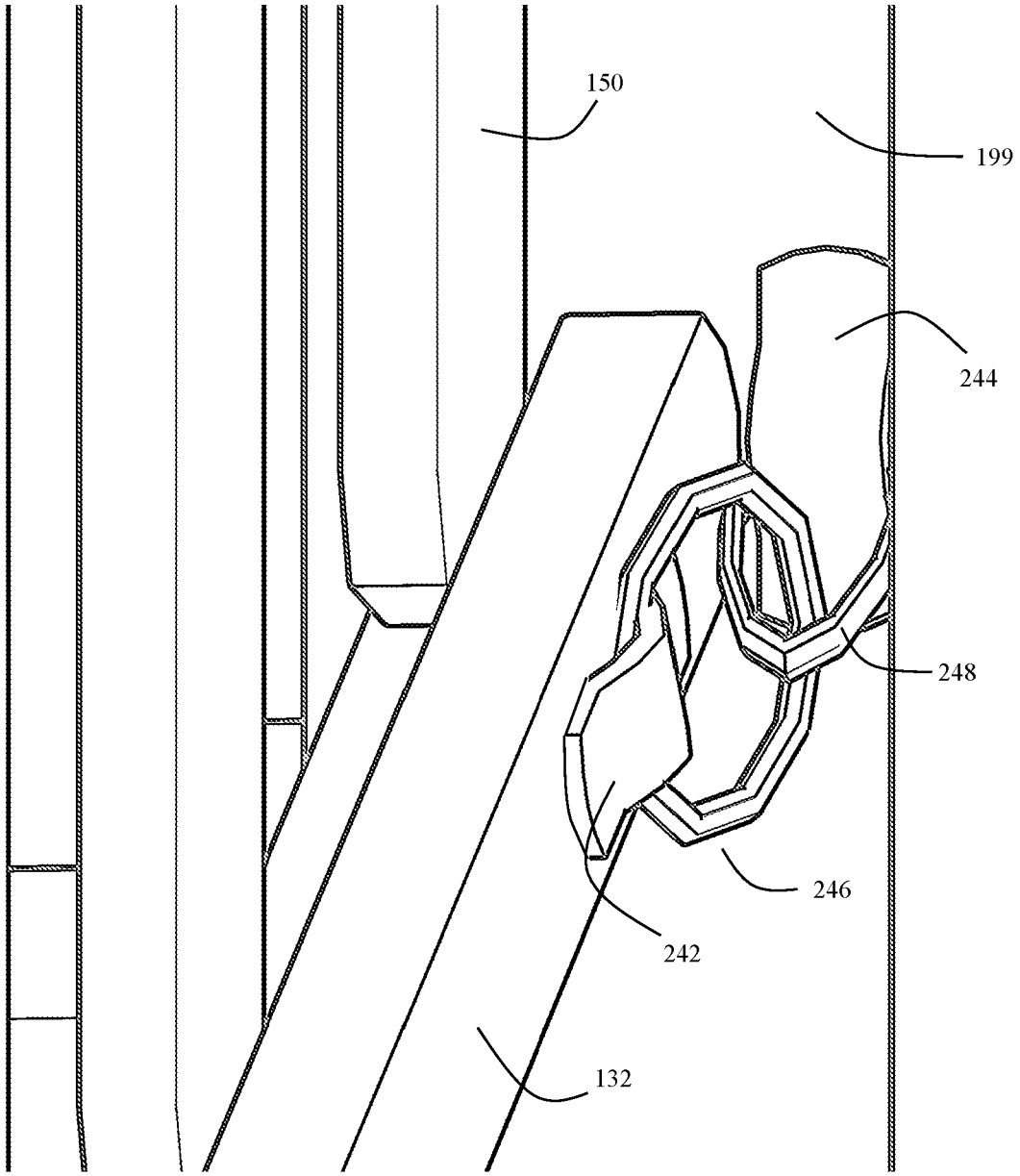
FIG. 15 shows a detail of the linking mechanism.

FIG. 15 shows a detail of the rail link mechanism (240), showing the two "U" shaped connector brackets (242, 244) and the two interlocking chain links (246, 248).

Kit Versions

As previously discussed, it is envisioned that home renovation enthusiasts will particularly value the adjustable staircase device and method taught herein. Such individuals often referred to as prosumers, may be amateurs (i.e., not professional carpenters) looking to add one or more additional stairs to their houses. Such individuals often prefer to purchase pre-fabricated kits where the various parts are already precut or otherwise in their final dimensions and may also be packaged with the various types of hardware disclosed herein.

Here, one of the main advantages of the present invention is that the same staircase device may be configured to fit into various buildings with various ceiling heights and floor dimensions. This enables the kit user to adjust the kit accordingly. Indeed, in some embodiments, the kit may be equipped with various precut upper or lower risers (122, 124) so that the appropriate set of riser tops and bottoms of suitable heights may be selected to further customize the staircase according to the particular building.

In such embodiment, the device or method may further comprise precutting or otherwise pre-forming the staircase components and dispensing them as a kit. Additionally, or alternatively, the device and method may further include retrieving these precut staircase components from a previously dispensed kit.

Materials:

Staircases are often made from wood (natural wood) or wood-based materials (e.g., processed wood such as plywood, particle board, and the like. Although it is anticipated that in many embodiments, the staircase taught herein will also comprise wood or wood-based materials, other materials may also be used. These include metal, fiberglass, plastic, plexiglass, glass, ceramic, and other construction materials.

The invention claimed is:

1. A staircase device;

said staircase comprising staircase components;

said staircase components comprising a plurality of steps, a plurality of adjustable height risers, fixed-length banisters, fixed-length stringers, Newel posts; a lower landing and an upper landing;

each said adjustable height riser comprising a top riser portion connected to a bottom riser portion by at least one riser hinge, such that the height of said adjustable height riser is configured by a two-portion angle between said top riser portion and said bottom riser portion;

said staircase configured so that adjusting a height between said lower landing and said upper landing comprises modifying said two-portion angle over at least some of said plurality of adjustable height risers.

2. The staircase device of claim 1, wherein at least some of said steps in said plurality of steps are attached to said fixed length stringers by pivot bolts or pivot joints, so that a step-stringer angle between at least some of said steps and said fixed length stringers is adjustable depending on said height of said adjustable height riser.

3. The staircase device of claim 2, wherein at least some of said steps in said plurality of steps are further attached to said fixed length stringers by at least one turnbuckle adjusted apparatus comprising a turnbuckle with a variable turnbuckle length; said device further configured so that adjusting said height between said lower landing and said upper landing further comprises modifying said variable turnbuckle length.

4. The staircase device of claim 1 wherein each said fixed length banisters comprises a banister upper railing, a banister lower railing, and a plurality of spindles mounted parallel to each other between said banister upper railing and said banister lower railing;

said Newel posts comprise a lower Newel post and an upper Newel post; and said fixed length banisters are attached to said lower and upper Newel post by at least one flexible linking mechanism configured so that an angle between said fixed length banisters and said Newel posts can vary depending on said height of said adjustable risers.

5. The staircase device of claim 4, wherein said spindles are mounted between said banister upper railing and said banister lower railing on movable joints, so that spindle angles between said banister upper railing and said banister lower railing can vary depending on said height of said adjustable risers.

6. The staircase device of claim 1, wherein said lower landing is supported by a lower landing frame with a lower landing frame height and lower landing space;

A lower portion of said fixed length stringers is configured to extend through a slot or hole in said lower landing into said lower landing space;

each said stringer is attached to any of said lower landing or said lower landing frame by a lower landing pivot mechanism, so that a stringer-lower-landing angle of said stringers with respect to said lower landing can vary depending on said height of said adjustable risers.

7. The staircase device of claim 1, wherein said upper landing is supported by an upper landing frame, and said upper landing frame is supported by an adjustable height post system;

wherein said device is configured so that adjusting a height between said lower landing and said upper landing further comprises modifying a height of said adjustable height post system.

8. The staircase device of claim 7, wherein said adjustable height post system comprises an adjustable support post base, and an adjustable support column; said post base and said support column configured to partially nest within each other so that the height of said adjustable height post system may be adjusted by configuring an extent of overlap between the two.

9. The staircase device of claim 1, wherein said staircase components are precut and dispensed as a kit.

10. The staircase device of claim 9, wherein at least some of said staircase components comprise natural or processed wood.

11. A method of assembling a staircase;

said staircase comprising staircase components;

said staircase components comprising a plurality of steps, a plurality of adjustable height risers, fixed-length banisters, fixed-length stringers, Newel posts; a lower landing and an upper landing;

each said adjustable height riser comprising a top riser portion connected to a bottom riser portion by at least one riser hinge, such that the height of said adjustable height riser is configured by a two-portion angle between said top riser portion and said bottom riser portion;

adjusting a height between said upper landing and said lower landing by modifying said two-portion angle over at least some of said plurality of adjustable height risers.

12. The method of claim 11, wherein at least some of said steps in said plurality of steps are attached to said fixed length stringers by pivot bolts or pivot joints, so that a step-stringer angle between at least some of said steps and said fixed length stringers is adjustable depending on said height of said adjustable height riser; and adjusting said step-stringer angle so that substantially all of said steps are level.

13. The method of claim 12, wherein at least some of said steps in said plurality of steps are further attached to said fixed length stringers by at least one turnbuckle adjusted apparatus comprising a turnbuckle with a variable turnbuckle length;

wherein adjusting said height between said lower landing and said upper landing further comprises modifying said variable turnbuckle length; and further using said turnbuckle to adjust said step-stringer angle so that substantially all of said steps are level.

14. The method of claim 11 wherein each said fixed length banisters comprises a banister upper railing, a banister lower railing, and a plurality of spindles mounted parallel to each other between said banister upper railing and said banister lower railing;

said Newel posts comprise a lower Newel post and an upper Newel post; and attaching said fixed length banisters to said lower and upper Newel post by at least one flexible linking mechanism so that an angle between said fixed length banisters and said Newel posts can vary depending on said height of said adjustable risers.

15. The method of claim 14, further mounting said spindles between said banister upper railing and said banister lower railing on movable joints, so that spindle angles between said banister upper railing and said banister lower railing can vary depending on said height of said adjustable risers.

16. The method of claim 11, wherein said lower landing is supported by a lower landing frame with a lower landing frame height and lower landing space;

A lower portion of said fixed length stringers is configured to extend through a slot or hole in said lower landing into said lower landing space;

each said stringer is attached to any of said lower landing or said lower landing frame by a lower landing pivot mechanism, and altering a stringer-lower-landing angle of said stringers with respect to said lower landing to vary depending on said height of said adjustable risers.

17. The method of claim 11, wherein said upper landing is supported by an upper landing frame, and said upper landing frame is supported by an adjustable height post system;

Further adjusting a height between said lower landing and said upper landing by modifying a height of said adjustable height post system.

18. The method of claim 17, wherein said adjustable height post system comprises an adjustable support post base, and an adjustable support column; said post base and said support column configured to partially nest within each other; and adjusting a height of said adjustable height post system by configuring an extent of overlap between the two.

19. The method of claim 11, further either a) precutting said staircase components and dispensing them as a kit; or b) retrieving said precut staircase components from a previously dispensed kit.

20. The method of claim 19, wherein at least some of said staircase components comprise natural or processed wood.

* * * * *